US006766748B2

(12) United States Patent
Insalaco et al.

(10) Patent No.: US 6,766,748 B2
(45) Date of Patent: Jul. 27, 2004

(54) TABLE WITH SUPPORT LEG HAVING AN ELONGATED CHANNEL

(75) Inventors: Robert W. Insalaco, Holland, MI (US); David J. Ritch, Malibu, CA (US); Mark B. Saffell, Manhattan Beach, CA (US); Gordon J. Stannis, West Olive, MI (US)

(73) Assignee: Herman Miller, Inc., Zeeland, MI (US)

( * ) Notice: Subject to any disclaimer, the term of this patent is extended or adjusted under 35 U.S.C. 154(b) by 46 days.

(21) Appl. No.: 09/975,244

(22) Filed: Oct. 10, 2001

(65) Prior Publication Data

US 2002/0043183 A1 Apr. 18, 2002

Related U.S. Application Data

(60) Provisional application No. 60/240,528, filed on Oct. 13, 2000.

(51) Int. Cl.[7] ..... A47B 37/00

(52) U.S. Cl. ..... 108/50.02; 108/157.18

(58) Field of Search ..... 108/50.02, 50.01, 108/157.1, 157.18, 64; 312/223.6

(56) References Cited

U.S. PATENT DOCUMENTS

| | | | | | |
|---|---|---|---|---|---|
| 2,010,342 | A | * | 8/1935 | Woods | 108/157.18 |
| 3,636,894 | A | | 1/1972 | Hage | |
| 4,296,981 | A | | 10/1981 | Hildebrandt et al. | |
| D309,993 | S | | 8/1990 | Miklos | |
| 5,237,935 | A | | 8/1993 | Newhouse et al. | |
| D342,403 | S | | 12/1993 | Magnusson | |
| 5,438,937 | A | * | 8/1995 | Ball et al. | 108/64 |
| 5,606,920 | A | * | 3/1997 | Meyer et al. | 108/50.02 |
| 5,678,380 | A | * | 10/1997 | Azzar | 52/716.4 |
| 5,704,299 | A | * | 1/1998 | Corpuz et al. | 108/50.01 |
| 5,715,761 | A | | 2/1998 | Frattini | |
| D394,567 | S | | 5/1998 | Hallenheim | |
| 5,878,673 | A | * | 3/1999 | Kramer et al. | 108/50.02 |
| 5,934,201 | A | * | 8/1999 | Diffrient | 108/50.02 |
| 5,934,203 | A | | 8/1999 | Glass | |
| 5,943,968 | A | * | 8/1999 | Dobson et al. | 108/124 |
| 5,974,985 | A | * | 11/1999 | Flototto et al. | 108/157.18 |
| 6,086,028 | A | | 7/2000 | Pfister | |
| 6,101,954 | A | * | 8/2000 | Rein et al. | 108/50.02 |
| 6,161,487 | A | * | 12/2000 | Chang | 108/50.01 |
| 6,267,064 | B1 | * | 7/2001 | Ostertag et al. | 108/50.02 |
| 6,283,043 | B1 | * | 9/2001 | Stern et al. | 108/50.02 |
| 6,598,542 | B2 | * | 7/2003 | Goldberg et al. | 108/64 |

FOREIGN PATENT DOCUMENTS

EP 396179 * 11/1990

OTHER PUBLICATIONS

Advertising excerpt, "Bretford Luna Table," Next Office, Sep. 18, 2000.
Advertising excerpt, "Here Retangular Table," Next Office, Sep. 18, 2000.
Advertising excerpt, "Propeller Table," The Knoll Shop, Sep. 18, 2000.

* cited by examiner

*Primary Examiner*—Jose V. Chen
(74) *Attorney, Agent, or Firm*—Brinks Hofer Gilson & Lione

(57) ABSTRACT

A table includes a support leg having an elongated channel extending longitudinally along at least a portion of the support leg and opening laterally outwardly from said support leg. The channel has an open end at a top of the support leg. In a preferred embodiment, a catch member extends across at least a portion of said channel and a worksurface is supported by the top of said support leg. In another aspect, the worksurface has a cutout shaped to receive at least a portion of the top of the support leg with at least a portion of the channel nested in the cutout. In a preferred embodiment, the support leg includes a socket that is shaped to receive a portion of the worksurface. A method of routing a utility line on a table is also provided.

26 Claims, 7 Drawing Sheets

TABLE WITH SUPPORT LEG HAVING AN ELONGATED CHANNEL

This application claims the benefit of U.S. Provisional Application Serial No. 60/240,528, filed Oct. 13, 2000, the entire disclosure of which is hereby incorporated by reference.

BACKGROUND

The present invention relates generally to a table, and in particular, to a table having a unique support leg and worksurface configuration that facilitates the routing of utility lines and the like.

In the modern home and office environment, it has become common for various electronic devices, such as computers, telephones, lights, etc., to be stored or located on top of various tables and desks for access by a user. Conventional tables and desks, however, are not typically configured with any type of conduit for routing the necessary power lines, cables, wires and/or other utility lines required for such devices from the top of the worksurface to the floor. Rather, conventional tables and desks are typically supported by one or more support legs having a solid appearance and/or configuration, and are typically constructed of metal or wood. Such support legs therefore are not generally configured to provide a conduit for the various utility lines. Rather, such lines are typically allowed to hang over one or more edges of the desk, which can provide for an unsightly appearance and which can get in the way of the user when working at or around the table or desk. Moreover, conventional tables can be rather heavy and generally cannot be easily moved by a single user, especially when configured without casters.

SUMMARY

Briefly stated, in one aspect of the invention, one embodiment of a table includes a support leg having an elongated channel extending longitudinally along at least a portion of the support leg and opening laterally outwardly from said support leg. The channel has an open end communicating with a top of the support leg. A catch member extends across at least a portion of the channel, and a worksurface is supported by the top of said support leg.

In another aspect, the support leg has an elongated channel and the worksurface has a cutout shaped to receive at least a portion of a top of the support leg with at least a portion of the channel nested in the cutout. In a preferred embodiment, the support leg includes a socket that is shaped to receive a portion of the worksurface.

In yet another aspect, a method of routing a utility line on a table includes providing a utility line disposed on a top of the worksurface, and running the line from the top of the worksurface into the channel formed in the support leg through the open end thereof.

In yet another aspect, a table includes at least four support legs, wherein at least two of the support legs terminate in casters and at least two of the support legs terminate in glides.

In yet another aspect, a table includes a worksurface having a rear edge, at least a portion of which has a concave contour. In a preferred embodiment, a trough is disposed along the rear edge of the table. In yet another aspect, a system of tables includes a first and second table, wherein the second table is positioned adjacent the first table with the rear edges thereof substantially abutting, wherein the portions of the rear edges having a concave contour form an opening between the first and second tables.

The present inventions provide significant advantages over other tables. For example, the support legs provide an ideal location to route utility lines from the worksurface to the floor or other venue. The channel provides a location to maintain the lines in an orderly configuration that improves the aesthetics of the desk, while at the same time reducing the clutter around the worksurface. In one preferred embodiment, wherein the worksurface includes a cutout, the channel can be nested in the cutout so as to reduce the overall footprint of the desk while at the same time maximizing the surface area of the worksurface surrounding the open end of the channel. Moreover, the interface of the worksurface with the socket of the support leg provides a strong, stable joint.

The table, whose legs are preferably made of glass-filled polypropylene, also is extremely light, and when configured in the preferred embodiment with at least a pair of casters, can be easily moved from one location to the next. In addition, when configured with a rear edge having a least a portion configured with a concave contour, an ideal location is provided to route utility lines between two or more desks arranged in a back-to-back configuration.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "rear", "side", "top", "bottom", "upwardly" and "downwardly" as used herein are intended to indicate the various directions and portions of the table, including the support leg and worksurface, as normally understood when viewed from the perspective of a user facing the table. The term "longitudinally" means placing or running lengthwise, and/or relating to length or the lengthwise dimension. The term "lateral" means situated on, directed toward, or extending or coming from the side.

Figure 1:
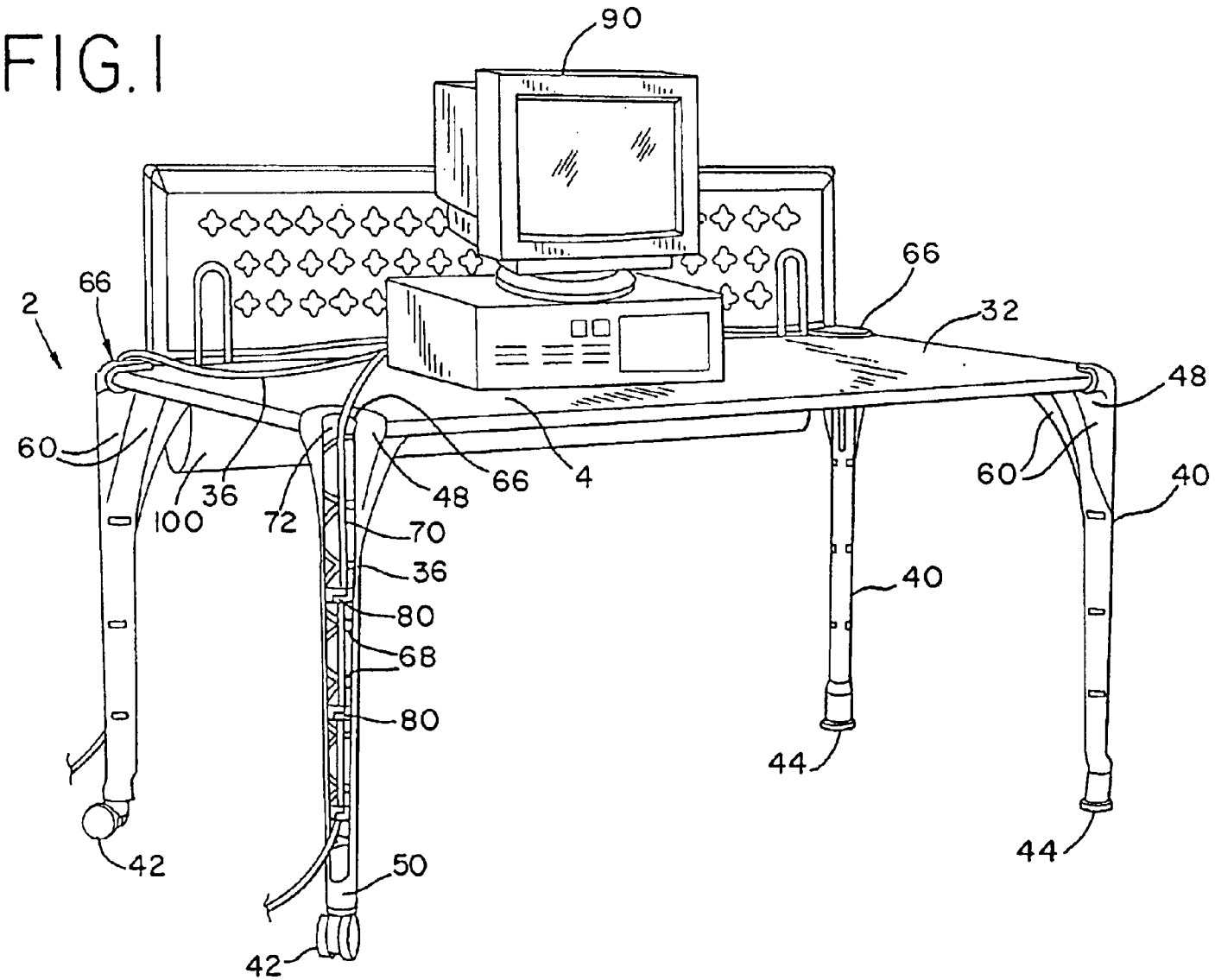
FIG. 1 is a perspective view of a table.
Figure 2:
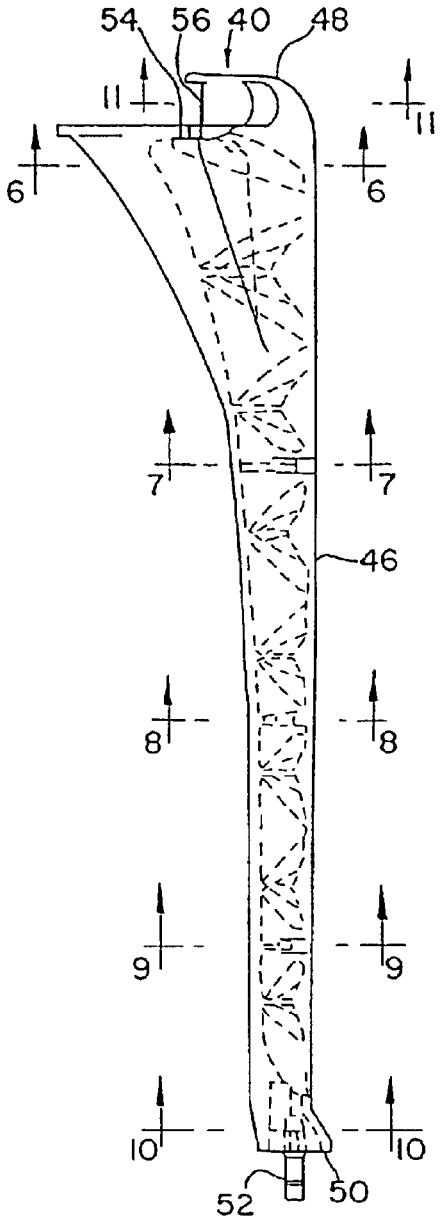
FIG. 2 is a side view of a support leg.
Figure 3:
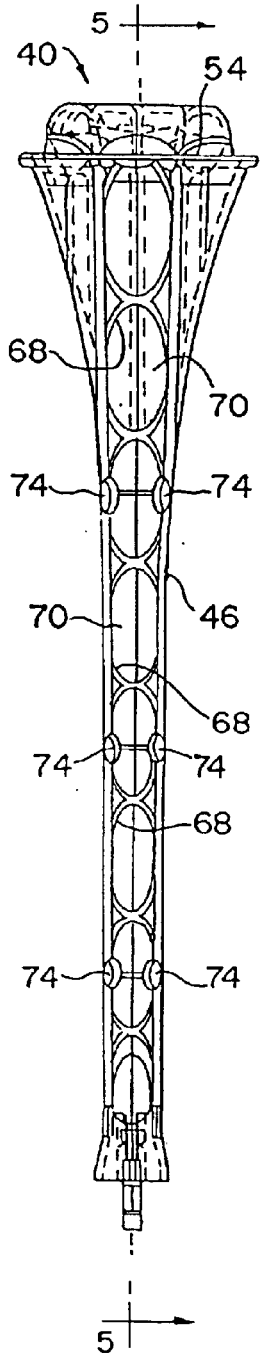
FIG. 3 is a front view of the support leg shown in FIG. 2.
Figure 4:
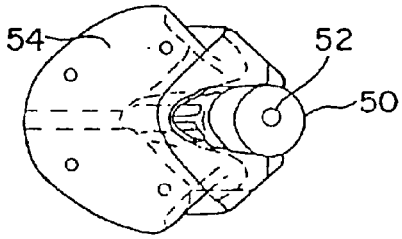
FIG. 4 is a bottom view of the support leg shown in FIG. 2.
Figure 5:
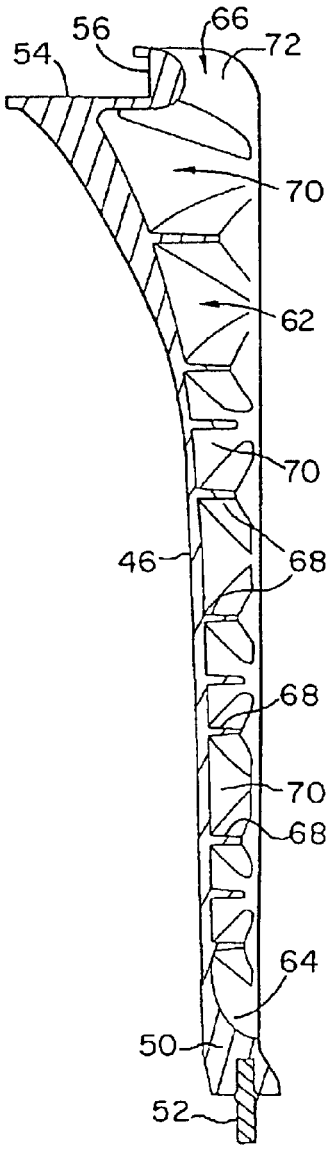
FIG. 5 is a cross-sectional view of the support leg taken along line 5—5 of FIG. 3.
Figure 6:
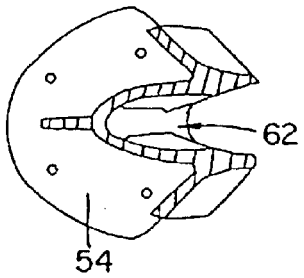
FIG. 6 is a cross-sectional view of the support leg taken along line 6—6 of FIG. 2.
Figure 7:
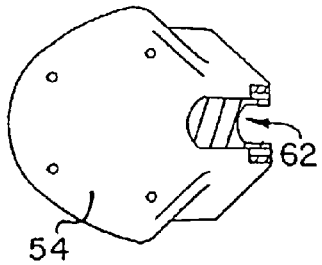
FIG. 7 is a cross-sectional view of the support leg taken along line 7—7 of FIG. 2.
Figure 8:
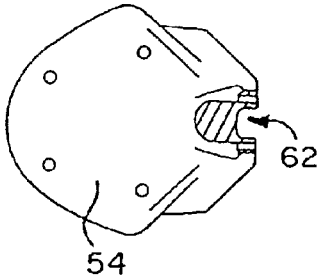
FIG. 8 is a cross-sectional view of the support leg taken along line 8—8 of FIG. 2.
Figure 9:
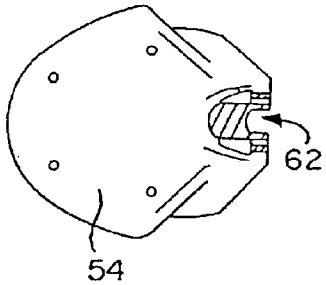
FIG. 9 is a cross-sectional view of the support leg taken along line 9—9 of FIG. 2.
Figure 10:
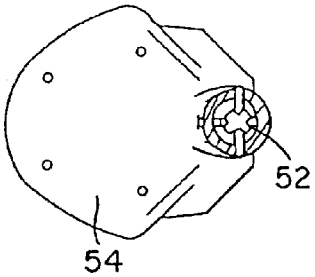
FIG. 10 is a cross-sectional view of the support leg taken along line 10—10 of FIG. 2.
Figure 11:
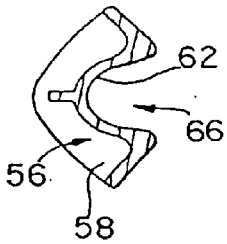
FIG. 11 is a cross-sectional view of the support leg taken along line 11—11 of FIG. 2.

Referring to the drawings, and as best shown in FIG. 1, a table 2 is shown as including a plurality of support legs 40 (shown as four) and a worksurface 4. Two of the support legs terminate in a caster 42, while the other two support legs terminate in a glide 44. The term "glide" means any structure or surface that slides or glides along a support surface, as opposed to a structure that rolls thereon, e.g., wheels. The glide can be configured as a separate part that is connected to the bottom of the support leg, or it can be integrally formed therewith. The glide can additionally be made height adjustable to allow the table to be adjusted and/or leveled. Of course, it should be understood that the four legs could be configured with any combination of glides and/or casters, and that the illustration of two casters and two glides is meant to be illustrative and not limiting. In such a preferred embodiment, the end of the table configured with glides can be lifted, such that the end with casters can be easily moved, thereby simplifying the portability of the table.

Figure 18:
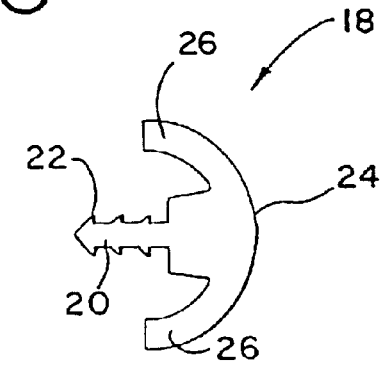
FIG. 18 is side view of an edge bumper member.

The worksurface 4 can be configured in a number of different shapes. For example, in a first embodiment shown in FIGS. 1, 14, 15 and 21, the worksurface 4 has a generally rectangular configuration. A rear edge 6 of the worksurface is curvilinear, and preferably includes at least a portion having a concave contour. The front and side edges 10, 8 are preferably linear, although it should be understood that they too can be configured with a curvilinear contour. Each corner of the worksurface preferably has a rectangular shaped cut-out 12 forming an internal corner 14. In addition, a groove 16 extends laterally inward along the peripheral edge of the worksurface, except along the edge defining the boundaries of the cut-outs 12. As shown in FIG. 18, an edge bumper member 18 has a barbed insert 20 that is inserted into the groove. The barbs 20 prevent the bumper from being removed once installed. The bumper includes a rounded cap portion 24 having a height substantially equal to the thickness of the worksurface. The cap portion 24 includes arm portions 26 that flex when the bumper is impacted. The bumper 18 protects the peripheral edge of the worksurface while providing at the same time an decorative molding around the periphery of the worksurface. In a preferred embodiment, the worksurface further comprises an elongated stiffener 28, preferably formed as a hat section, attached to a bottom surface 30 thereof with a plurality of fasteners, adhesive or both. The stiffener 28 extends longitudinally along a portion of the length of the worksurface and provides increased strength and rigidity to the worksurface. The hat section is preferably made of metal.

Figure 20:
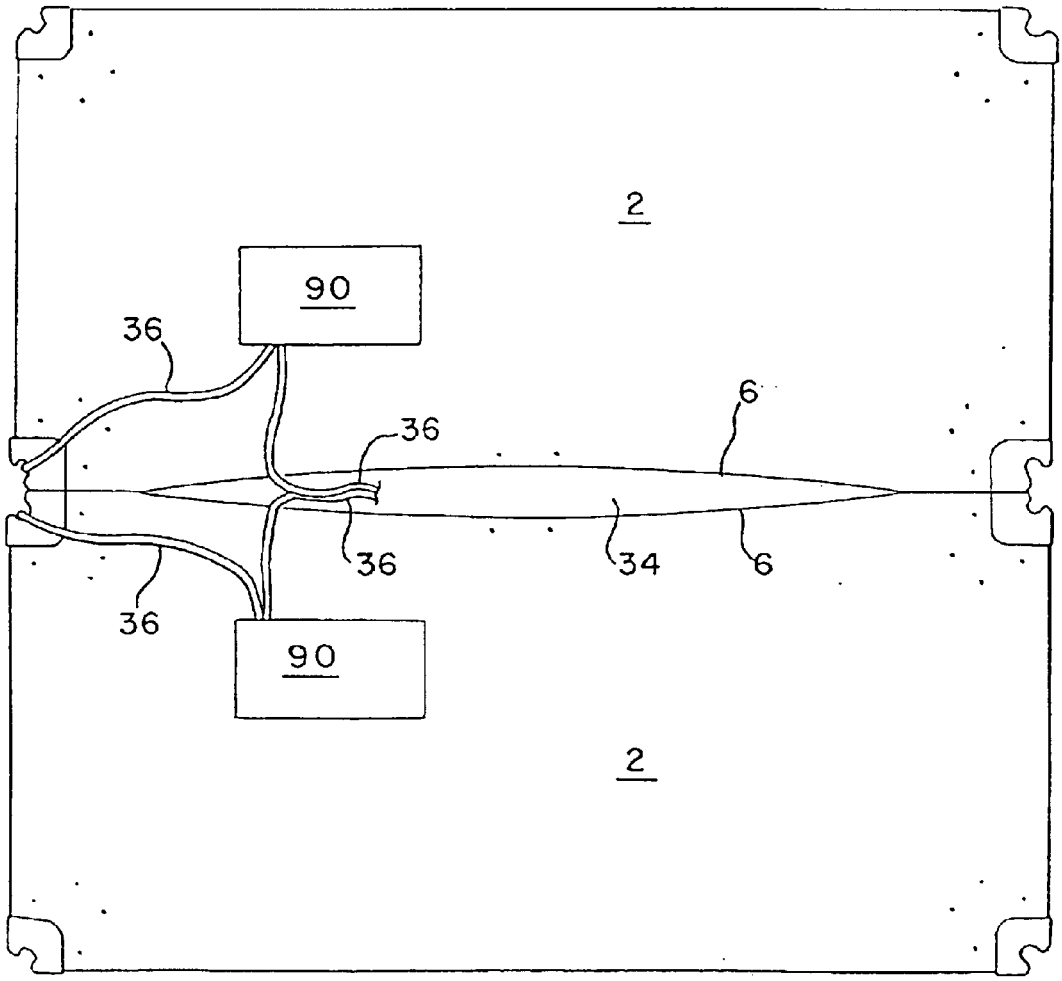
FIG. 20 is a plan view of a pair of tables arranged in a back-to-back configuration.

When two tables 2 are arranged in a back-to-back configuration with the rear edges 6 thereof substantially abutting, as shown in FIG. 20, the concave portion of the rear edges forms an opening 34 between the tables. The opening 34 provides an ideal location to route cables 36 as they are passed over the rear edge 6.

Figure 19:
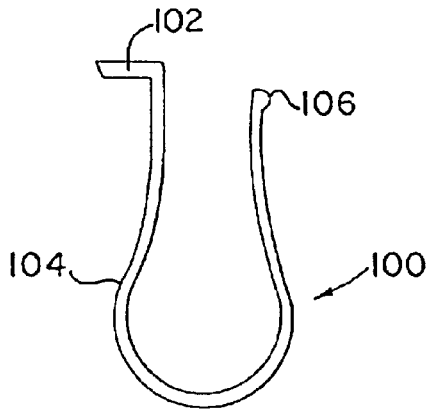
FIG. 19 is an end view of a trough.

In a preferred embodiment, the table 2 includes a trough 100, shown in FIGS. 1 and 19, disposed along the rear edge 6 of the table. The trough 100 includes a flange 102 that is preferably secured to the bottom 30 of the worksurface with a plurality of fasteners. An opposite end of the trough terminates in a bead 106, which is preferably free-floating. The trough 100 includes a plurality of longitudinally extending ribs 104 which increase the strength and rigidity of the trough. In use, the user can dispose utility lines in the trough for storage or routing as they are passed over the rear edge of the table. The term "utility line" as used herein means any electrical, data or communication line, including any wire, cable, fiber optics, or other flexible line, whether electrical, coaxial, optical or other, which is typically routed from one or more pieces of office equipment, including without limitation computers, telephones, and/or other electronic devices.

Figure 16:
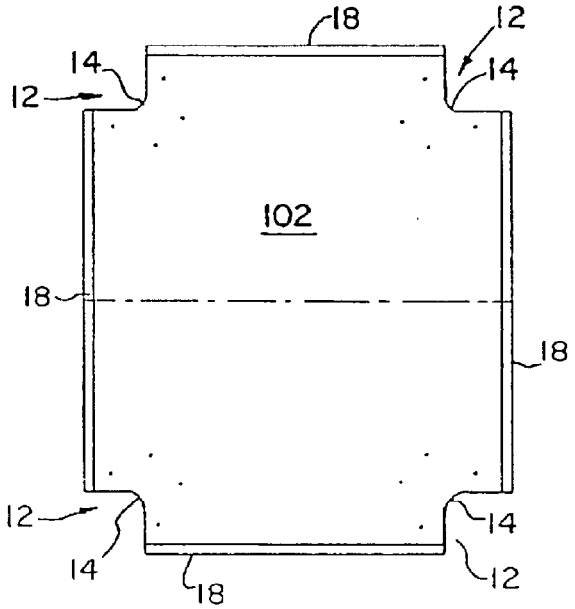
FIG. 16 is a bottom view of an alternative embodiment of a worksurface.

In an alternative embodiment, shown in FIG. 16, the worksurface 102 is rectangular, and substantially more square than the first embodiment. In this embodiment, the worksurface is preferably configured without a hat section. In yet another embodiment, shown in FIG. 17, a corner worksurface 202 includes parallel front and rear edges 210, 206, with the front edge 210 being longer than the rear edge 200. The front and rear edges are preferably curvilinear. The worksurface 202 further includes first and second substantially perpendicular side edges 212, 214 formed at an angle with the front and rear edges 210, 206. The worksurface 202 includes six cutouts 12 formed at the six junctions of the various front, rear and side edges. The worksurface 202 further preferably includes a hat section stiffener 28 secured to a bottom surface 230 thereof.

Figure 17:
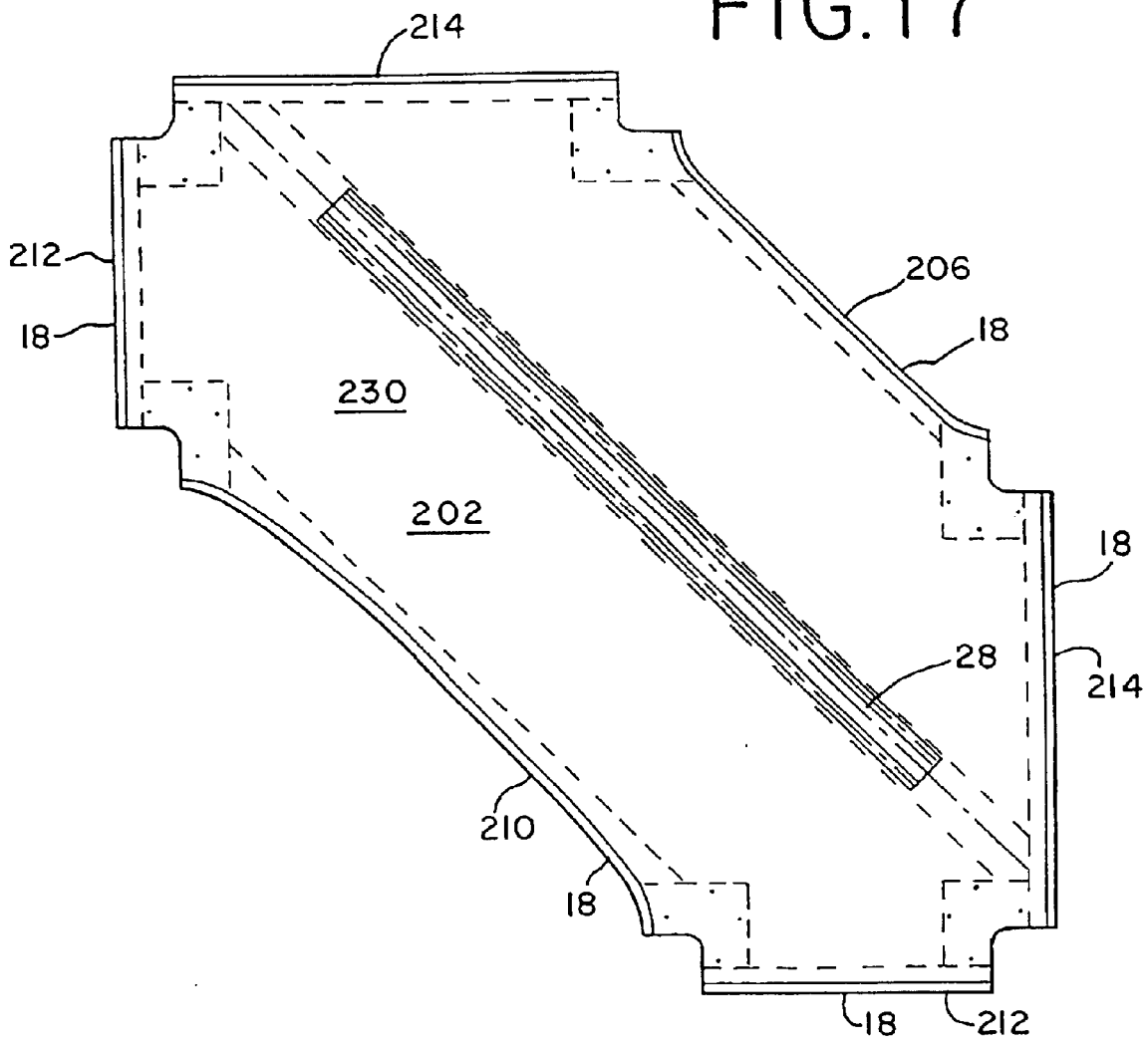
FIG. 17 is a bottom view of an alternative embodiment of a worksurface.
Figure 21:
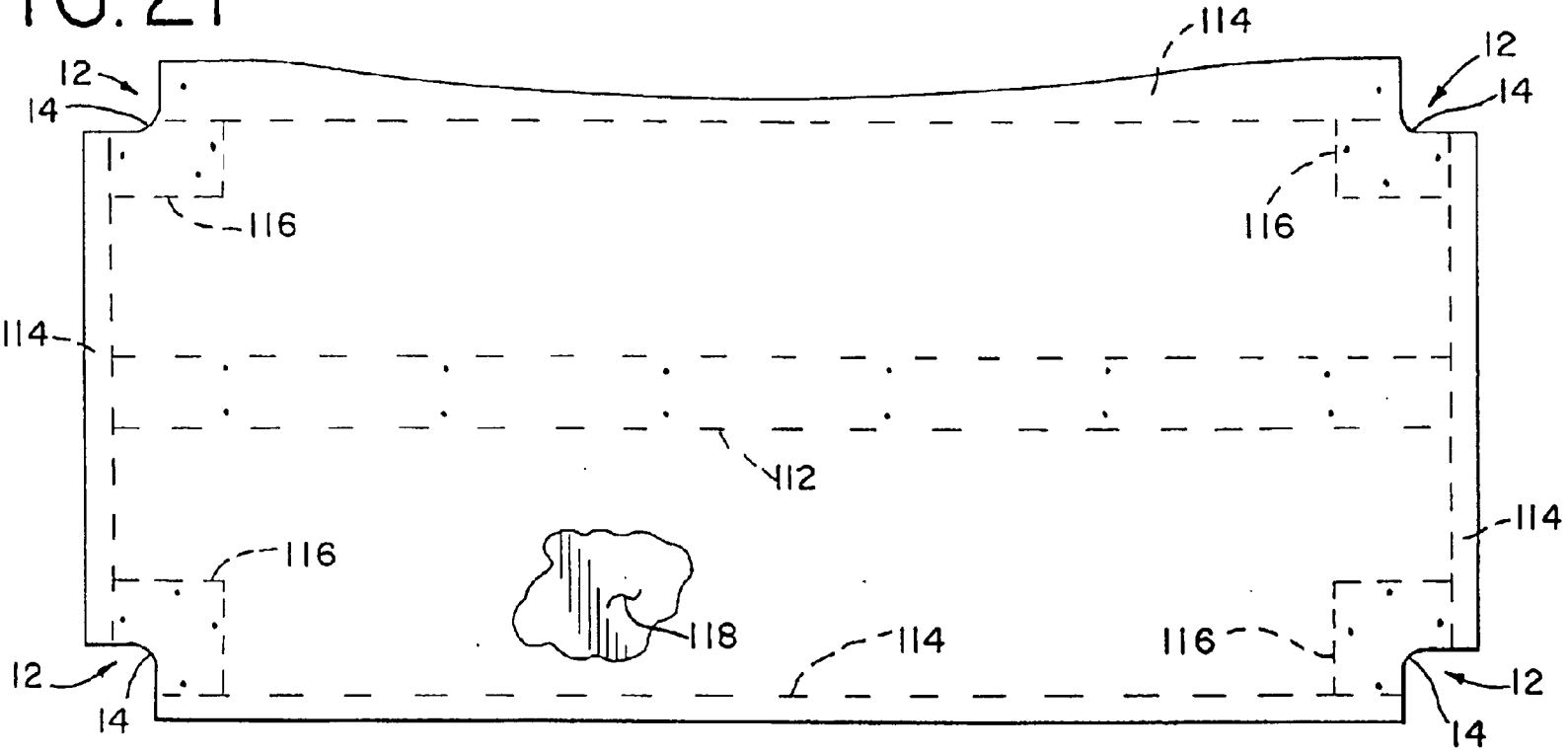
FIG. 21 is a top view of one embodiment of a worksurface core.
Figure 22:
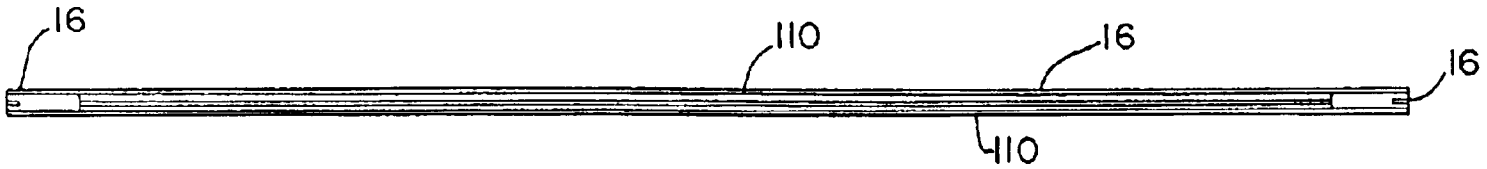
FIG. 22 is a rear view of the core shown in FIG. 21.

As best shown in FIGS. 17 and 21, each of the worksurface embodiments preferably includes a core including an upper and lower ⅛ inch hardboard layer 110. The core further includes a central rail 112 made of particle board, so as to provide a backing for the stiffener, fir rails 114, in which the groove 116 is formed, and corner blocks 116, which serve as a backing for the support legs, disposed between the hardboard layers. The hardboard layers are preferably roll coated with a clear acrylic melamine finish (available for example from Colledgewood in Lincoln, Calif.) prior to it being cut and attached to the rails, preferably by bonding with an adhesive. In this way, no finishing of the table worksurface is required after assembly. The remainder of the space between the outer hardboard layers is filled with a corrugated honeycomb structure 118. It should be understood that the various rails can be interchangeably made of fir or particle board, or of any other wood or other material.

Referring to FIGS. 1–11, the support leg 40 includes an elongated stem 46, a top 48 and a bottom 50. The bottom includes a stud insert 52, which extends therefrom for attachment with the caster or glide. Of course, it should be understood that the bottom of the stem could simply rest on the floor with the bottom surface thereof serving as a glide. The top 48 of the support leg includes a support platform 54 and a socket 56 or cavity shaped to receive the internal corner 14 of the worksurface formed at each of the cutouts 12. The socket is defined in part by the support platform 54 and an upper flange 58, which overlaps an upper surface 32 of the worksurface. A pair of webs extend from the stem to support the support platform.

The support leg further includes a channel 62 that runs longitudinally along substantially the entirety of the support leg. The channel 62 is tapered along its length, such that it has a greater depth at the top of the support leg than at the bottom thereof. The channel 62 terminates at a curved portion 64 adjacent the bottom 50 of the support leg. The channel 62 has an open end 66 at the top of the support leg. When the support leg 40 is mounted to the worksurface 2, 102, 202, with a portion thereof, and preferably the internal corner 14 inserted into the socket 56, at least a portion of the channel 62 is nested in the cut-out 12. A plurality of fasteners are used to secure the support platform 54 to the bottom 30 of the worksurface, as the fasteners engage the backing material or corner blocks 116 of the core for increased rigidity. The support leg 40 further includes a plurality of ribs 68 formed along the surface of the channel which define a plurality of recesses 70, including a series of elliptically shaped recesses aligned axially along the channel.

Figure 12:
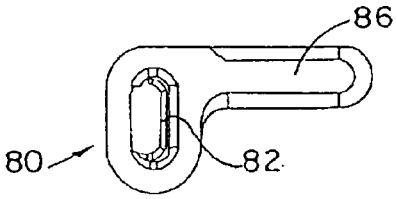
FIG. 12 is a front view of a catch member.
Figure 13:
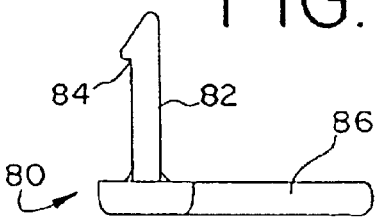
FIG. 13 is a top view of the catch member shown in FIG. 12.
Figure 14:
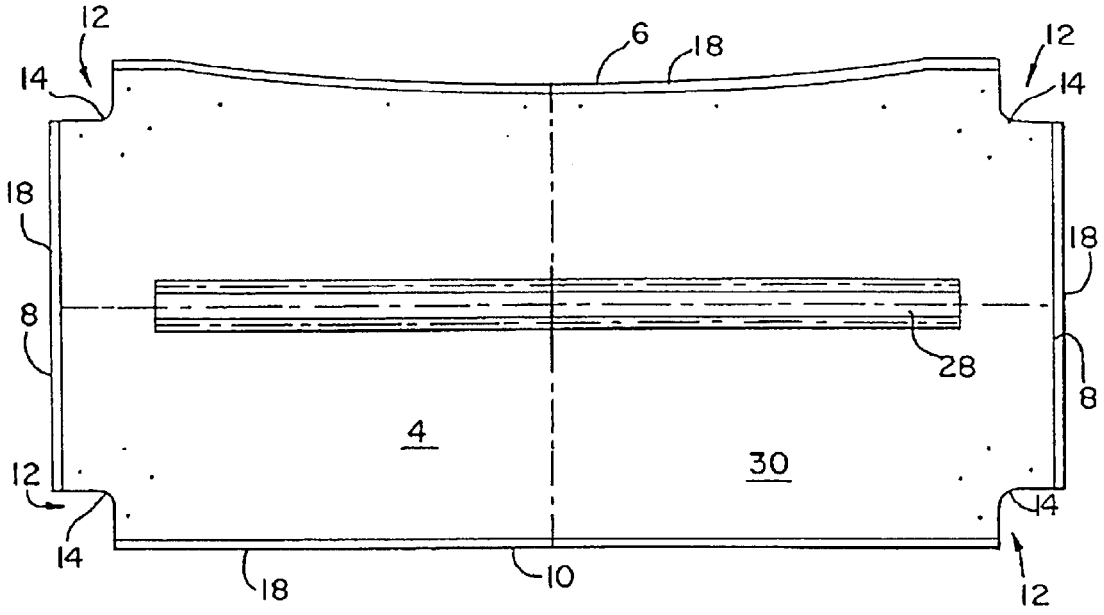
FIG. 14 is a bottom view of one embodiment of a worksurface.
Figure 15:
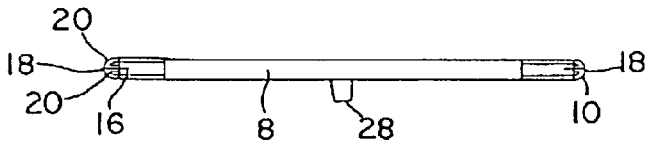
FIG. 15 is an end view of the worksurface shown in FIG. 14.

The support leg further includes three pairs of openings 74 spaced along the length of the support leg. Each opening 74 is formed on one side of the channel adjacent an edge thereof. As shown in FIGS. 1, 12 and 13, an L-shaped catch member 80 includes an insert portion 82 having a catch 84 configured as a hook or barb formed on an end thereof. The catch member 80 further includes a cross member 86 extending laterally from the insert portion 82. The insert portion 82 is inserted through the opening 74 such that the catch 84 engages a rear edge or ledge of the support leg stem 46, with the cross member 86 extending across at least a portion of the mouth of the channel. A similar catch member 80 is inserted in the opening 70 on the opposite side of the channel, with the cross-member rotated 180 degrees such that it overlaps and nests with the first catch member. In this way, the catch members 80 extend substantially across the entirety of the mouth of the cavity to form a barrier. The catch members 80 are preferably made of a flexible polyethylene. The support leg 40 is preferably made of compression molded glass-filled polypropylene with a U.V. stabilizer added thereto. The material is preferably about 40% glass-filled polypropylene. In particular, molten polypropylene is mixed with glass fibers and extruded to form a cylindrical "shot" controlled by weight. The hot, molten shot is placed between two halves of a leg mold (not shown), which are closed under high pressure to mold the shot into the shaped support leg. The support leg is cooled and removed from the mold.

To assemble the table, the support legs 40 are installed at each of the cut-outs 72 formed in the worksurface. The bumpers 18 along each peripheral edge of the worksurface adjacent the cut-out extend into the socket 56 formed in the top 48 of the support legs. Accordingly, the bumpers 18 can be pre-cut to size and assembled on the worksurface prior to attachment of the support leg. In this way, the bumpers do not have to be trimmed to match the leg or cut-out, which simplifies the assembly process and saves manufacturing costs. In addition, the top flange 58 of the top 48 of the support leg overlaps the upper surface 32 of the worksurface as the channel 62 is nested in the cutout 12. In this way, the open end 66 of the channel communicates with the top of the worksurfaces and is surrounded or bounded by the worksurface. The mouth 72 of the open end 66 is curved around the periphery thereof so as to provide a smooth surface for utility lines as they pass into the channel 62, and thereby avoids any sharp edges that can abrade the lines. Fasteners are used to secure the support platform 54 to the bottom 30 of the worksurface.

In use, various utility lines 36 are run from various pieces of office equipment 90 disposed on the upper surface 32 of the worksurface 2, 192, 292 into the channel 62 through the open 66 end thereof. The lines 36 can then be run along the channel 62 to the bottom of the support leg, where they can then be routed to another conduit on the floor, or to an outlet or other venue. The lines 36 can be passed behind the cross members 86 of the catch members 80, which maintain the position of the lines in the channel. The lines can be pressed past the flexible cross members 86 to dispose them in the channel 62, or they can be threaded behind the cross members 86.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A table comprising:

a support leg having an elongated channel extending longitudinally along at least a portion of said support leg and opening laterally outwardly from said support leg, said channel having an open end communicating with a top of said support leg, wherein said channel has a first depth at a first location proximate said top of said support leg and wherein said channel has a second depth at a second location distal to said top of said support leg, wherein said first depth is greater than said second depth;

a catch member extending across at least a portion of said channel; and a worksurface supported by said top of said support leg.

2. The table of claim 1 wherein said worksurface further comprises a cutout, wherein said top of said support leg is connected to said worksurface at said cutout.

3. The table of claim 1 wherein said top of said support leg further comprises a socket, wherein a portion of said worksurface is received in said socket.

4. The table of claim 1 wherein said top of said support leg further comprises a support platform, wherein a bottom of said worksurface is supported on said support platform.

5. The table of claim 1 wherein said worksurface comprises a inwardly extending groove formed around at least a portion of the periphery thereof, and further comprising a bumper having an insert inserted into said groove.

6. A table comprising:

a support leg having an elongated channel extending longitudinally along at least a portion of said support leg and opening laterally outwardly from said support leg, said channel having an open end communicating with a top of said support leg, wherein said channel is defined by a depth, and wherein said depth of said channel is tapered along the length thereof;

a catch member extending across at least a portion of said channel; and a worksurface supported by said top of said support leg.

7. A table comprising:

a support leg having an elongated channel extending longitudinally along at least a portion of said support leg and opening laterally outwardly from said support leg, said channel having an open end communicating with a top of said support leg, wherein said support leg has an opening formed along one side of said channel;

a catch member extending across at least a portion of said channel, and wherein said catch member comprises an insert portion inserted in said opening of said support leg and a cross member extending from said insert portion across at least a portion of said channel; and a worksurface supported by said top of said support leg.

8. The table of claim 7 wherein said opening in said support leg is a first opening, and wherein said support leg has a second opening formed along an opposite side of said channel opposite said first opening, and further comprising a second catch member having an insert portion inserted in said second opening and a cross member extending from said insert portion across at least a portion of said channel, wherein said cross members of said first and second catch members extend across the entirety of the channel.

9. The table of claim 1 wherein said worksurface comprises a rear edge, wherein at least a portion of said rear edge has a concave contour.

10. The table of claim 1 wherein said support leg is made of glass filled polypropylene.

11. The table of claim 1 wherein said support leg further comprises a plurality of ribs formed in said channel.

12. A table comprising:

a support leg having an elongated channel extending longitudinally along at least a portion of said support leg and opening laterally outwardly from said support leg, said channel having an open end at a top of said support leg; and a worksurface supported by said top of said support leg, wherein said worksurface has a cutout shaped to receive at least a portion of said top of said support leg with at least a portion of said channel nested in said cutout.

13. The table of claim 12 wherein cutout is located at a corner of said worksurface.

14. The table of claim 13 wherein said channel opens diagonally outwardly from said corner of said worksurface.

15. The table of claim 12 wherein said top of said support leg further comprises a socket, wherein a portion of said worksurface is received in said socket.

16. The table of claim 12 wherein said top of said support leg further comprises a support platform, wherein a bottom of said worksurface is supported on said support platform.

17. The table of claim 12 wherein said worksurface comprises a inwardly extending groove formed around at least a portion of the periphery thereof, and further comprising a bumper having an insert inserted into said groove.

18. The table of claim 12 wherein said channel is defined by a depth, and wherein said depth of said channel is tapered along the length thereof.

19. The table of claim 12 further comprising a catch member extending across at least a portion of said channel.

20. The table of claim 19 wherein said support leg has an opening formed along one side of said channel, and wherein said catch member comprises an insert portion inserted in said opening and a cross member extending from said insert portion across at least a portion of said channel.

21. The table of claim 12 wherein said worksurface comprises a rear edge, wherein at least a portion of said rear edge has a concave contour.

22. The table of claim 12 wherein said support leg comprises a plurality of ribs formed in said channel.

23. A method for routing a utility line on a table comprising:

providing said table comprising a support leg having an elongated channel extending longitudinally along at least a portion of said support leg and opening laterally outwardly from said support leg, said channel having an open end at a top of said support leg, and a worksurface supported by said top of said support leg, wherein said worksurface has a cutout shaped to receive at least a portion of said top of said support leg with at least a portion of said channel nested in said cutout;

providing a utility line having at least a portion disposed on a top of said worksurface; and running said utility line from said top of said worksurface into said channel through said open end thereof.

24. The method of claim 23 wherein said support leg comprises a catch member extending across at least a portion of said channel, and wherein said running said utility line further comprises running said utility line in said channel behind said catch member and thereby capturing said utility line in said channel.

25. The method of claim 23 wherein said worksurface comprises a rear edge at least a portion of which has a concave contour and wherein said utility line comprises a plurality of utility lines, and further comprising passing one of said plurality of utility lines from said top of said worksurface over said rear edge at said portion thereof having a concave contour.

26. The method of claim 25 further comprising providing a trough disposed along said rear edge, and disposing said utility line passing over said rear edge in said trough.

* * * * *